US012593881B2

(12) United States Patent
Ross

(10) Patent No.: US 12,593,881 B2
(45) Date of Patent: Apr. 7, 2026

(54) MOLLE RETENTION SYSTEM

(71) Applicant: First-Light USA, LLC, Seymour, IL (US)

(72) Inventor: Jeremy B. Ross, Monticello, IL (US)

(73) Assignee: FIRST-LIGHT USA, LLC, Seymour, IL (US)

( * ) Notice: Subject to any disclaimer, the term of this patent is extended or adjusted under 35 U.S.C. 154(b) by 52 days.

(21) Appl. No.: 18/163,695

(22) Filed: Feb. 2, 2023

(65) Prior Publication Data

US 2023/0270187 A1 Aug. 31, 2023

Related U.S. Application Data

(60) Provisional application No. 63/269,227, filed on Mar. 11, 2022, provisional application No. 63/268,578, filed on Feb. 25, 2022.

(51) Int. Cl.
*A44B 13/00* (2006.01)
*A41D 13/00* (2006.01)

(52) U.S. Cl.
CPC ..... *A41D 13/0007* (2013.01); *A44B 13/0029* (2013.01)

(58) Field of Classification Search
CPC ..... A44B 13/0029; A45F 5/02; F21V 21/088; A41D 13/0012
See application file for complete search history.

(56) References Cited

U.S. PATENT DOCUMENTS 2,539,974 A 1/1951 Riddell
5,056,696 A 10/1991 Lahr
5,083,246 A 1/1992 Lambert
5,183,324 A 2/1993 Thomas
5,617,582 A * 4/1997 Burwell ..... A41D 13/0012 2/119

(Continued)

FOREIGN PATENT DOCUMENTS

CN 203656591 U 6/2014
EP 4252581 A1 * 10/2023 ..... A45F 5/02

(Continued)

OTHER PUBLICATIONS

International Search Report and Written Opinion mailed Feb. 12, 2019, from the ISA/US, for International Application No. PCT/US18/62773 (filed Nov. 28, 2018), 10 pgs.

(Continued)

*Primary Examiner* — Tajash D Patel
(74) *Attorney, Agent, or Firm* — Ascenda Law Group, PC

(57) ABSTRACT

A retention system for securing an article to a webbing or similar attachment system. The retention system includes one or more rigid or semi-rigid elongated members adapted to fit to said webbing, and including one or more attachment points adapted to receive a securing portion of said article. The members may be arranged as a pair thereof separated from one another by a longitudinal opening and joined to one another at one end of each of the members. A gate located near an open end of the longitudinal opening is positionable to selectively obstruct the open end of the longitudinal opening. The attachment points may be arranged, for example, along an exterior longitudinal edge of each respective elongated member.

15 Claims, 12 Drawing Sheets

(56) References Cited

U.S. PATENT DOCUMENTS

| | | | | |
|---|---|---|---|---|
| 6,224,235 | B1 | 5/2001 | Parker | |
| 6,481,869 | B1 | 11/2002 | Horandel et al. | |
| 6,604,837 | B2 | 8/2003 | Sandberg | |
| 6,619,813 | B1 | 9/2003 | Schnell | |
| 6,695,269 | B1 | 2/2004 | Anscher | |
| 6,953,259 | B2 | 10/2005 | Parsons et al. | |
| 7,185,997 | B2 | 3/2007 | Simoni | |
| 7,774,864 | B2 * | 8/2010 | Carlson | A41D 13/0012 2/249 |
| 8,297,562 | B1 * | 10/2012 | Yeates | F41C 33/045 248/222.51 |
| 8,851,697 | B2 | 10/2014 | Quitner | |
| 8,950,640 | B2 * | 2/2015 | Iannello | A45F 5/00 224/660 |
| 9,366,419 | B2 | 6/2016 | Osborn | |
| 9,572,382 | B2 * | 2/2017 | Donovan | A41D 19/0093 |
| 9,702,534 | B1 | 7/2017 | Brion | |
| 9,732,948 | B1 | 8/2017 | Malina et al. | |
| 10,465,887 | B1 | 11/2019 | Levy et al. | |
| 10,670,201 | B1 | 6/2020 | Noble | |
| 10,716,350 | B2 | 7/2020 | Waters | |
| 10,731,835 | B2 | 8/2020 | Ross | |
| 10,782,006 | B1 | 9/2020 | Ross | |
| 10,907,811 | B2 | 2/2021 | Ross | |
| 10,995,940 | B2 | 5/2021 | Kaye | |
| 11,287,117 | B2 | 3/2022 | Ross et al. | |
| 11,478,035 | B2 | 10/2022 | Waters | |
| 11,480,321 | B2 | 10/2022 | Ross et al. | |
| 11,805,890 | B1 * | 11/2023 | Mandeville | A45F 5/021 |
| 11,992,097 | B1 * | 5/2024 | Wagner | A45F 5/021 |
| 2004/0246706 | A1 | 12/2004 | Simoni | |
| 2005/0094385 | A1 | 5/2005 | Lee | |
| 2006/0087833 | A1 | 4/2006 | Simoni | |
| 2007/0158380 | A1 * | 7/2007 | Calkin | A41D 13/0012 224/675 |
| 2008/0049433 | A1 | 2/2008 | Sharrah et al. | |
| 2008/0174991 | A1 | 7/2008 | Tucker | |
| 2009/0027876 | A1 | 1/2009 | Yu | |
| 2009/0190333 | A1 | 7/2009 | Sohn | |
| 2010/0232147 | A1 | 9/2010 | Bryant et al. | |
| 2010/0309655 | A1 | 12/2010 | Sohn | |
| 2011/0063826 | A1 | 3/2011 | Lau | |
| 2011/0255286 | A1 | 10/2011 | Christ et al. | |
| 2012/0175391 | A1 * | 7/2012 | Rogers | F41C 33/045 224/191 |
| 2014/0338157 | A1 * | 11/2014 | Iannello | A44B 11/04 24/318 |
| 2015/0192282 | A1 | 7/2015 | Ormsbee et al. | |
| 2017/0163942 | A1 | 6/2017 | Teetzel | |
| 2017/0205204 | A1 * | 7/2017 | Tien | F41H 1/02 |
| 2017/0292659 | A1 | 10/2017 | Bayat | |
| 2018/0368560 | A1 * | 12/2018 | Evans | A45F 5/02 |
| 2019/0053561 | A1 | 2/2019 | Volmer | |
| 2019/0093867 | A1 | 3/2019 | Qiu | |
| 2019/0178477 | A1 | 6/2019 | Ross | |
| 2019/0261604 | A1 | 8/2019 | Solan et al. | |
| 2020/0318818 | A1 | 10/2020 | Ross | |
| 2022/0061506 | A1 * | 3/2022 | Woodward | A45F 3/14 |
| 2023/0180859 | A1 * | 6/2023 | Williams | A45F 5/02 2/265 |

FOREIGN PATENT DOCUMENTS

| | | | | |
|---|---|---|---|---|
| GB | 2610633 A * | 3/2023 | | A45F 5/02 |
| WO | WO-2004110208 A1 * | 12/2004 | | A45F 5/02 |

OTHER PUBLICATIONS

International Application No. PCT/US2018/062773 filed Nov. 28, 2018; International Preliminary Report on Patentability dated Mar. 4, 2020; IPEA/US; 15 pgs.

First-Light USA LLC, "TRS Molle Blade instruction sheet" (2 pgs.) (2014).

* cited by examiner

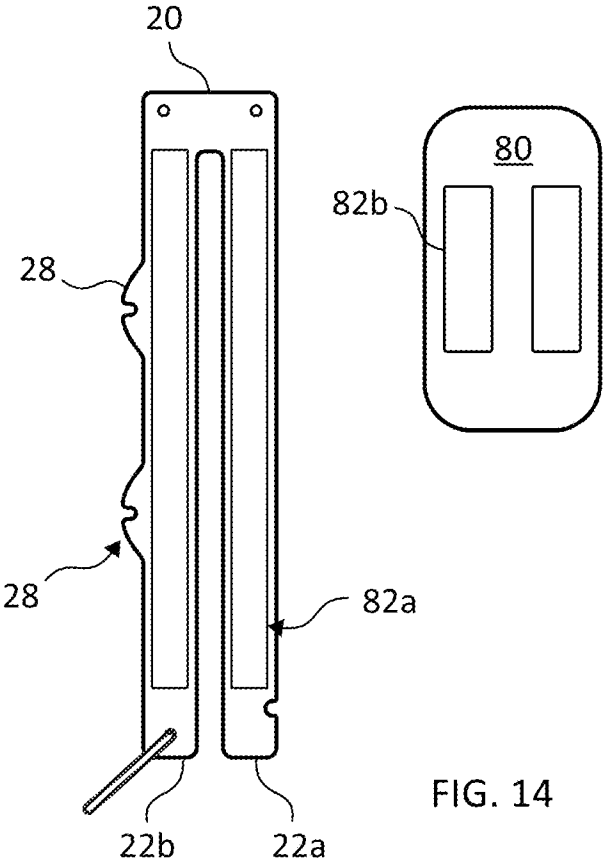
FIG. 14
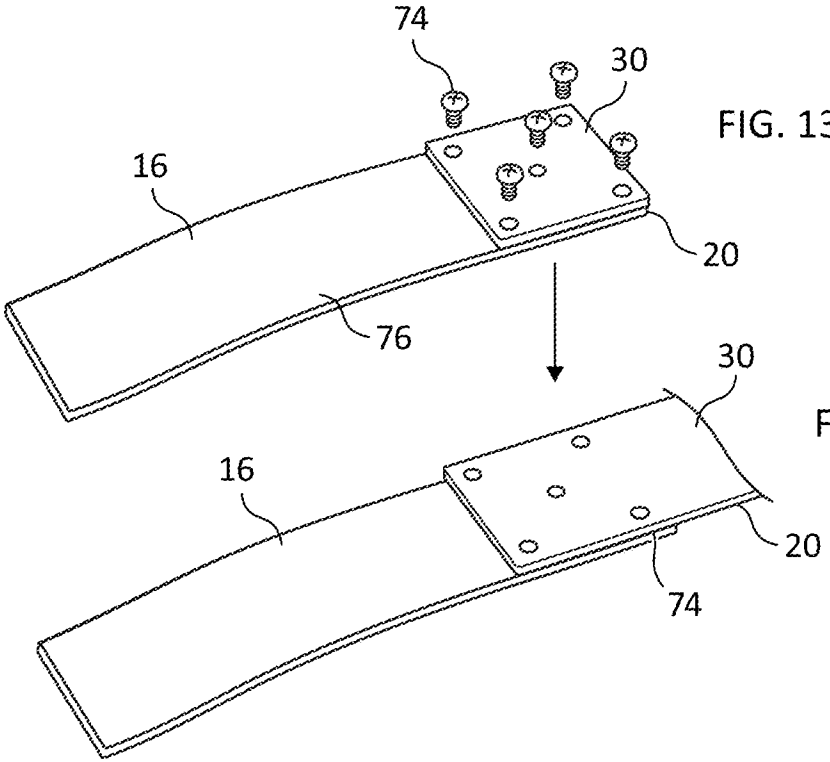
FIG. 13A
FIG. 13B

MOLLE RETENTION SYSTEM

RELATED APPLICATIONS

This application is a NONPROVISIONAL of, claims priority to, and incorporates by reference U.S. Provisional Application Nos. 63/268,578, filed Feb. 25, 2022, and 63/269,227, filed Mar. 11, 2022.

FIELD OF THE INVENTION

The present invention relates generally to a retention system for securing articles to webbing or similar wearable apparatus.

BACKGROUND

Modular lightweight load-carrying equipment (MOLLE) is a well-known system, typically worn as a vest or similar garment, used by military personnel and civilians alike. The modularity of the system is derived from the presence of pouch attachment ladder system (PALS) webbing stitched onto the MOLLE in rows of heavy-duty nylon loops to allow for the attachment of various compatible pouches and accessories. The pouches and other accessories are attached to the loops of the MOLLE (or, sometimes, each other) using a series of woven nylon straps. This arrangement is illustrated in FIGS. 1 and 2, which show a pouch 10 attached to a MOLLE (e.g., a vest) 12 via a number of PALS webbings 14 stitched onto the MOLLE 12. As shown, the attachment is made by weaving nylon straps 16, which are sewn onto the back of pouch 10, through loops in the PALS webbing. To ensure the pouch is retained close to the MOLLE 12, the straps 16 are alternatingly weaved through loops in a first row of PALS webbing 14, then through similar loops in webbing 18 on the pouch itself, then through a next row of PALS webbing on the MOLLE 12, and so on, until the complete (or nearly so) lengths of the straps 16 are so arranged. Any excess length of the strap(s) is (are) then reattached to the pouch, for example using a hook and loop fastener, or is (are) simply tucked back under the lower portion of the pouch 10.

Current MOLLE systems employ PALS webbing loops that are typically sewn in horizontal rows separated from one another at approximate 1.5-inch increments and while the weaving of nylon straps through webbing loops on the MOLLE and any articles attached thereto provides for relatively stable and secure attachment of those articles to the MOLLE, it is a cumbersome process and does not allow for rapid removal of the attached items as the nylon fabric straps must be unwoven before the article can be removed from the MOLLE. Depending on the article, this may demand removing the MOLLE itself, which is often impossible or at least impractical for the wearer.

SUMMARY OF THE INVENTION

In one embodiment, the present invention provides a retention system for securing an article to a webbing or similar attachment system. The retention system includes one or more semi-rigid elongated members adapted to fit to said webbing and including one or more attachment points adapted to receive a securing portion of the article. The elongated members may be arranged as a pair, separated from one another at least along a portion of their respective lengths by a longitudinal opening and joined to one another at a first respective end of each of the members opposite an open end of the longitudinal opening. A gate (e.g., a locking wire, an elastic ring, a locking unit adapted to rotate about a position on one of the elongated members, a member that swings closed and open, a cap that covers ends of the elongated members, a barrel bolt latch, a chain latch, a portion of one or both of the elongated members, a hook and loop closure system, a snap closure system, a hook and hole closure arrangement, or a portion of one or both of the elongated members that forms a narrowing of the longitudinal opening between the elongated members near their respective ends) may be located near the open end of the longitudinal opening and configured to at least partially obstruct the open end of the longitudinal opening. For example, the gate may be positionable between a first position in which the gate does not obstruct the open end of the longitudinal opening and a second position in which the gate obstructs the open end of the longitudinal opening. In some cases, a gap exists between the elongated members and a base portion of the retention system. The gap may be adapted to receive portions of the webbing and may be formed by the pair of elongated members folding under the base portion. In some embodiments, an attachment bracket is displaced from the elongated members by approximately a width of the gap. The attachment points may be adapted to receive any of a loop, strap, latch, snap, pin or slot, or other securing portion of the article that is to be attached to the webbing.

Further embodiments of the invention provide a securing system for an article for use with a MOLLE retention system. The securing system includes a two piece attachment for such an article, for example a front piece and a back piece configured to mate with one another so as to enclose a portion of a webbing of the article between them. In some cases, the two piece attachment may be a securing loop attachment and at least one of the front and back pieces may have a securing loop. Alternatively, the two piece attachment may be a securing toggle having one or more horns.

Another embodiment of the present invention provides a retention system for securing an article to a webbing. The retention system includes hingeably connected rigid or semi-rigid elongated members, a first one of which includes slots therein adapted to receive securing elements of said article and a second one of which is adapted to fit to the webbing. One of the hingeably connected members may include a securing gate or a notch for receiving a securing gate, and the securing gate may be adapted to fit the other of the hingeably connected members. Either of the hingeably connected members may include one or more attachment points adapted to receive a securing portion of the retention system, for example attachment points positioned along its exterior longitudinal edge, while the other of the hingeably connected members includes the securing portion of the retention system, for example one or more loops of elastic cord.

These and further embodiments of the invention are discussed in greater detail below in connection with the figures of the accompanying drawings.

BRIEF DESCRIPTION OF THE DRAWINGS

The present invention is illustrated by way of example, and not limitation, in the figures of the accompanying drawings, in which:

FIGS. 13A and 13B illustrate examples of accessories for retrofitting of articles that have existing nylon (or other) straps for use with retention systems configured in accordance with embodiments of the present invention.

FIG. 14 shows an alternative retention system for securing an article to a MOLLE in accordance with further embodiments of the present invention.

DESCRIPTION OF THE INVENTION

Figure 2:
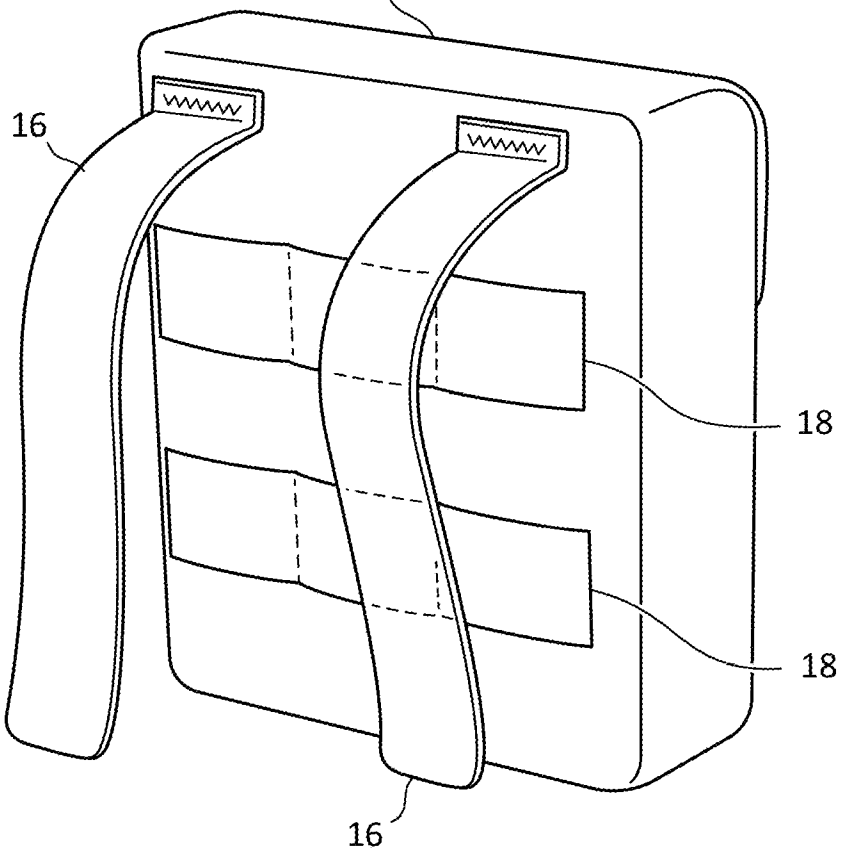
FIG. 2 (Prior Art)
FIGS. 1 and 2 illustrate a conventional pouch and its means of attachment to a MOLLE article via a number of PALS webbings stitched onto the MOLLE article.

The present invention overcomes the disadvantages of the above-described conventional means of attaching articles to MOLLE. In one embodiment, the need to weave nylon straps through loops of PALS webbing is eliminated through the use of a retention system that includes one or more rigid or semi-rigid elongated members adapted to fit to a PALS or other webbing and which include one or more attachment points adapted to receive a securing portion of an article to be attached or secured to the webbing. The elongated members may be arranged as a pair, separated from one another by a longitudinal opening at least along a portion of their lengths for accommodating a rib in the webbing (e.g., a sewing rib or a similar rib fashioned by welding the webbing onto a MOLLE or similar system, or a rib created by laser cutting slots in a MOLLE or similar system). In some cases, one or both of the elongated members may be fitted with a gate configurable to obstruct the longitudinal opening. The longitudinal opening between the elongated members terminates in an end defined by respective ends of the elongated members, and, where present, the gate is positionable between a first position in which the gate does not obstruct the end of the longitudinal opening and a second position in which the gate obstructs the end of the longitudinal opening. Further, in some cases, one or both of the elongated members may include attachment points along its or their respective outside longitudinal edge(s), where such attachment points can be used to secure an article being attached to the MOLLE, for example using elastic cord retention loops or other means. The retention system may also include a common base portion, wherein the pair of elongated members extend from the common base portion towards the end defined by the respective ends of the elongated members, or each elongated member may extend from its own base portion. For example, the common base portion or respective base portions of each elongated member may provide a nylon strap that can be sewn to the article being attached, or the common base portion or respective base portions of each elongated member may be attachable to existing portions of the article being attached, for example by being riveted, welded, or otherwise bonded thereto. Further, in some instances the retention system may include a gap between the common base portion and the elongated members or gaps the respective base portions of each elongated member and those respective elongated members, with the gap(s) adapted to receive portions of the webbing to which the retention system will be fitted. For example, such a gap may be formed by the pair of elongated members folding under the common base portion (e.g., to form a U-shaped arrangement). The attachment points may be adapted to receive any of a loop, strap, latch, snap, pin or slot, or other securing portion of the article that is to be attached to the webbing.

Where present, the gate of the retention system may be a locking wire. For example, a locking wire may be secured to a first one of the pair of elongated members by passing through a hole the first one of the pair of elongated members. And, the locking wire may be further configured to removably engage a second one of the pair of elongated members to obstruct the end of longitudinal opening when the locking wire is in the second position. In some cases, the locking wire may be configured to removably engage the second one of the pair of elongated members at a recess in a longitudinal outside edge of the second one of the pair of elongated members when in the second position. And, the locking wire may be further configured to removably engage the first one of the pair of elongated members when in the first position. For example, the locking wire may be further configured to removably engage the first one of the pair of elongated members at a recess in a longitudinal outside edge of the first one of the pair of elongated members when in the first position. Thus, each respective one of the pair of elongated members may include a recess in a respective longitudinal outside edge thereof for removably engaging the gate and the gate may be adapted to rotate about a position on one of the elongated members. In other embodiments of the invention, the gate may be a member that swings closed and open, or a cap that covers the ends of the longitudinal members. The cap could be attached to the retention system or not when it is not in use. Alternatively, the gate may be a barrel bolt latch or a chain latch. In still further embodiments, the gate may be a portion of one or both of the elongated members that are attachable to one another. For example, a lower portion of one or both of the elongated members may be moveable so as to attach to the other elongated member by a hook and loop fastener, a snap, or a hook and hole arrangement. In still other embodiments, the gate may be a portion of one or both of the elongated members that forms a narrowing of the longitudinal opening between the elongated members near their respective ends, thereby acting as an impediment for accidental removal of the longitudinal members from the loops of webbing while not completely blocking the longitudinal opening between the elongated members near their respective ends.

Figure 4:
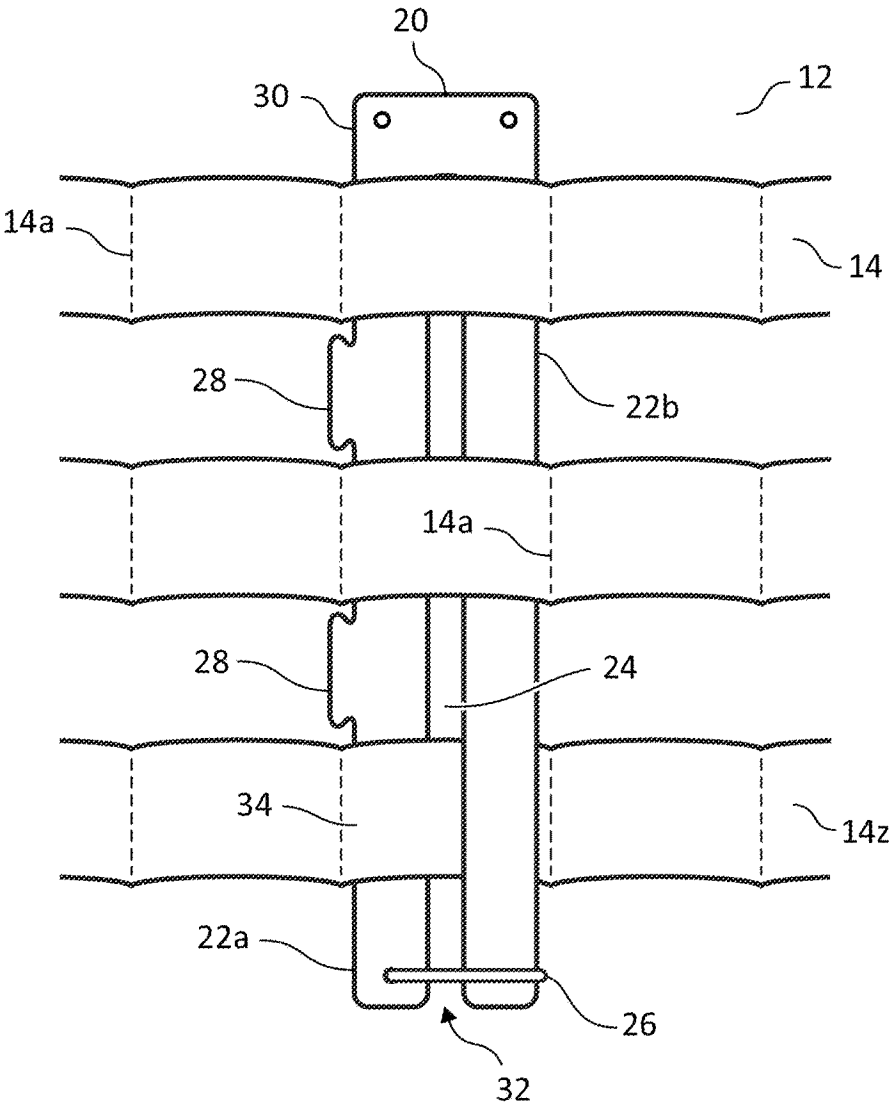
FIGS. 3 and 4 illustrate an example of a retention system including a pair of rigid or semi-rigid elongated members separated from one another by a longitudinal opening for accommodating one or more ribs in PALS or other webbing according to an embodiment of the present invention.
Figure 3:
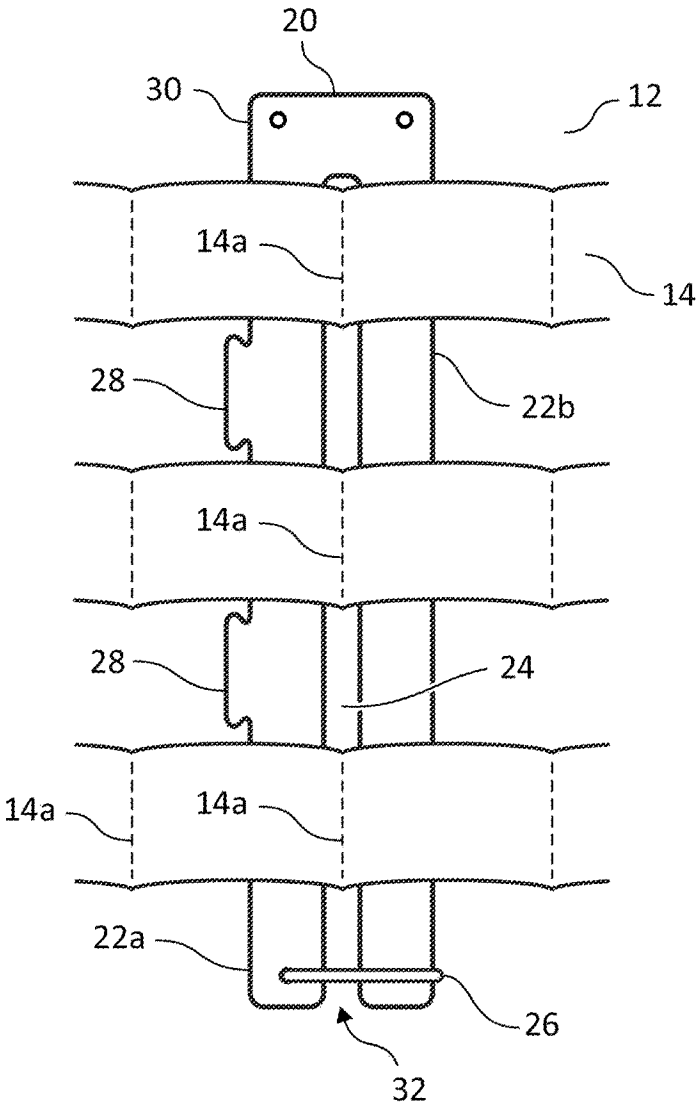

Referring now to FIGS. 3 and 4, an example of a retention system 20 configured according to an embodiment of the present invention is shown. Retention system 20 includes a pair of rigid or semi-rigid elongated members 22*a*, 22*b* separated from one another by a longitudinal opening 24 at least along a portion of their lengths for accommodating one or more ribs 14*a* in PALS or other webbing 14 (e.g., a sewing rib or a similar rib fashioned by welding the webbing onto a MOLLE or similar system, or a rib created by laser cutting slots in a MOLLE or similar system). Although the examples shown and described herein treat the elongated members as being of equal (or nearly so) lengths, this need not necessarily be the case and in any of the disclosed embodiments herein the elongated members may be of different lengths. The context in which the retention system is to be employed will usually determine the appropriate length or lengths of the elongated members and in some cases the elongated members may be telescoping or otherwise configurable in respect of their length or lengths.

In some cases, one or both of the elongated members 22*a*, 22*b* may be fitted with a gate 26 configurable to obstruct the longitudinal opening 24. The longitudinal opening 24 between the elongated members 22*a*, 22*b* terminates in an end 32 defined by respective ends of the elongated members 22*a*, 22*b*, and, where present, the gate 26 is positionable between a first position in which the gate 26 does not obstruct the end 32 of the longitudinal opening 24 and a second position in which the gate 26 obstructs the end 32 of the longitudinal opening 24. Further, in some cases, one or both of the elongated members 22*a*, 22*b* may include attachment points 28 along its or their respective outside longitudinal edge(s) 22*a*, 22*b*, where such attachment points can be used to secure an article being attached to the MOLLE, for example using elastic cord retention loops or other means. The retention system 20 may also include a common base portion 30, wherein the pair of elongated members 22*a*, 22*b* extend from the common base portion 30 towards the end 32 of the longitudinal opening defined by the respective ends of the elongated members 22*a*, 22*b*, or each elongated member may extend from its own base portion (not shown in these views). For example, the common base portion 30 or respective base portions of each elongated member 22*a*, 22*b* may provide a nylon strap that can be sewn to the article being attached, or the common base portion 30 or respective base portions of each elongated member 22*a*, 22*b* may be attachable to existing portions of the article being attached, for example by being riveted, welded, or otherwise bonded thereto. Common base portion 30 provides a convenient location for attaching retention system 20 to an article, such as a pouch or other article.

As shown in FIG. 3, in some instances the retention system 20 (and the associated article to which it is attached) may be fitted to MOLLE 12 by positioning the elongated member 22*a*, 22*b* in adjacent loops of webbing 14 so that a rib 14*a* that separates the loops from one another is accommodated within the longitudinal opening 24 between the elongated member 22*a*, 22*b*. Then, the elongated members 22*a*, 22*b* may be passed through loops of successive rows of webbing 14 of the MOLLE 12 for their entire (or nearly so) lengths, and the end 32 of the longitudinal opening 24 closed by gate 26 below the lowermost rib 14*a* of the rows of webbing loops. With both ends of the longitudinal opening 24 closed, the upper end thereof by the common base portion 20 (or another gate) and the lower end 32 thereof by gate 32, the retention system is well secured to the MOLLE 12 and should not come dislodged therefrom. The gate 26 may be a locking wire, or may be an elastic or semi-elastic loop (such as an O-ring), a member that swings closed and open, or a cap that covers the two ends of the clip arms. The cap could be attached to the clip or not when it is not in use. Alternatively, the gate may be a barrel bolt latch or a chain latch. Other examples of gates are described below with respect to FIGS. 15-18.

FIG. 4 shows an alternative manner of fitting retention system 20 to webbing of a MOLLE. In this example, both elongated members 22*a*, 22*b* of the retention system 20 are passed through common loops in successive rows of webbing 14 and in one or more rows of the webbing the different ones of the elongated members 22*a*, 22*b* are passed on different sides of the fabric loop. For example, in this illustration in row 14*z* of the webbing, elongated member 22*a* passes on the back side of fabric loop 34, while elongated member 22*b* passes on the front side of fabric loop 34. This arrangement is accommodated by the presence of longitudinal opening 24 between the two elongated members and when gate 26 is arranged so as to close end 32 of the longitudinal opening below row 14*z* of the webbing, the retention system 20 is secured in place within the common loops in successive rows of webbing 14 (e.g., in a column of such loops). Allowing the retention system 20 to be organized in this fashion means that spacing of articles on MOLLE 12 can now be done based on individual columns of fabric loops, rather than pairs of columns of fabric loops as was required with conventional retention systems.

As noted above, attachment points 28 along one or more outside longitudinal edge(s) of elongated members 22*a*, 22*b* provide areas for securing an article being attached to the MOLLE. They may further provide additional means for securing the retention system to the webbing 14. For example, depending on the shape of the attachment points 28, they may prevent the inadvertent displacement of the elongated members 22*a*, 22*b* in a direction orthogonal (or nearly so) to the lengths of webbing that define the loops of fabric through which the elongated members pass. While this may be desirable in some arrangements of retention system 20, in other arrangements it may be something to be avoided and so the elongated members may be fabricated so that they are thicker in an area of the elongated member corresponding to a location of an attachment point 28. By being thicker in such areas, when the elongated member is being removed from the webbing, the elongated member will tend to expand the webbing loop it is being drawn through, thereby helping to ensure that the attachment point 28 passes through the webbing loop without catching on it. Various shapes of attachments points 28 may be used, for example the cleat-shape shown in FIGS. 3 and 4, as well as shapes such as bollards, toggles, T-bars, horns, stanchions, bolsters, beams, shims, spires, chocks, spurs, wedges, and so on.

The elongated members 22*a*, 22*b* of the retention system 20 may be made from any of a variety of materials. In one embodiment, the elongated members 22*a*, 22*b* are made of a thermoplastic acrylic-polyvinyl chloride material, such as that sold under the trade name Kydex, available from Sekisui SPL. Other acrylic-polyvinyl chloride materials such as IPK acrylic-polyvinyl chloride may also be used, as may other thermo-formable acrylic-polyvinyl chloride composites. In other embodiments, materials such as plastics (e.g., Zylonite), metals and/or metal alloys, cellulose acetates (including but not limited to nylon), carbon fiber, epoxy resins, and combinations of the foregoing may be used.

Figure 6:
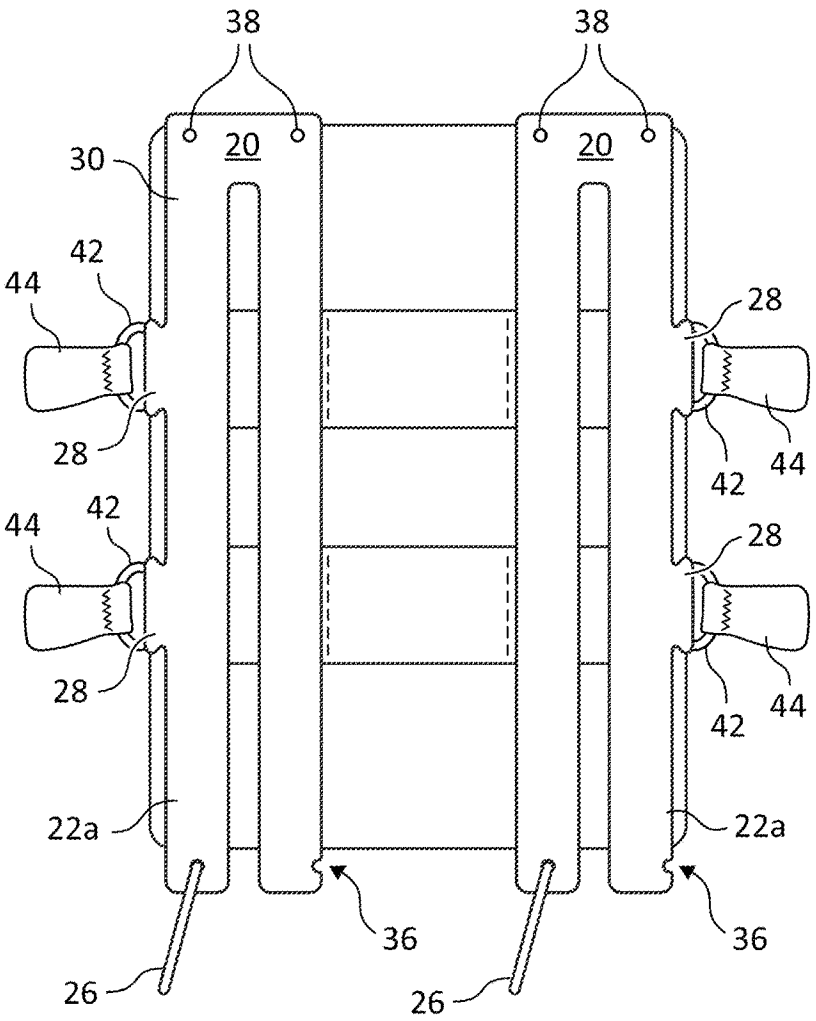
FIGS. 5 and 6 illustrate an example of an article and its attachment to a MOLLE by way of a pair of retention systems configured in accordance with embodiments of the present invention.
Figure 5:
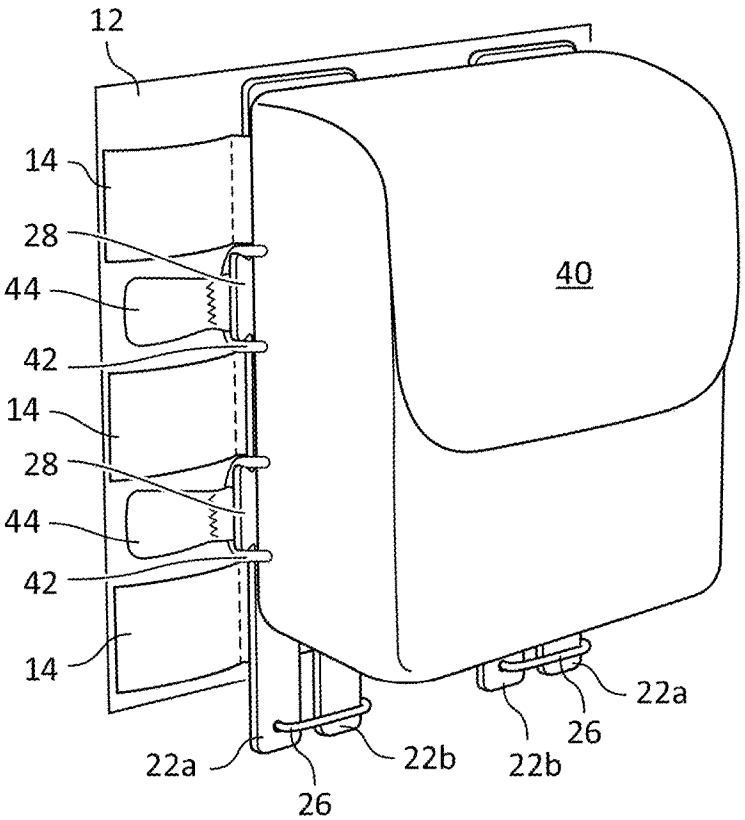

Referring now to FIGS. 5 and 6, an example of an article, in the form of a pouch 40, for attachment to a MOLLE by way of a pair of retention systems 20 is shown. FIG. 5 shows a front view depicting the attachment of pouch 40 to MOLLE 12, while FIG. 6 shows the back side of pouch 40 and the attachment of two retention systems 20 thereto. In this example, retention systems 20 are attached to pouch 40 by means of rivets 38 at the common base portions 30 of each respective retention system 20. However, in other examples other forms of attachment could be used. For example, retention systems 20 may be sewn or welded to pouch 40, or may include elongated members 22*a*, 22*b* with nylon strap portions to be sewn to pouch 40 or portions of nylon or other straps thereof. For example, a conventional pouch 10, such as that depicted in FIG. 2, may be retrofitted with a retention system 20 by cutting the straps 16 and attaching one or more pairs of elongated members 22*a*, 22*b* thereto, either at a common base portion 30, or at individual base portions thereof. The attachment to straps 16 (that is, the remaining portions thereof after cutting the straps) may be made by any convenient means, such as by sewing, riveting, welding, clamping, gluing, etc., the elongated members 22*a*, 22*b* or a common base 30 thereof.

In these illustrations, pouch 40 is fitted with one or more securing loops 42. Securing loops 42 may be made of a heavy elasticized cord, such as shock cord, bungee cord, or similar material, and sewn into or onto or otherwise fastened to pouch 40. The securing loops 42 may be fitted with a pull tab 44 made of cloth or other material. As shown in FIG. 5, when a retention system 20 of a pouch 40 is fitted to MOLLE 12 by having its elongated members 22*a*, 22*b*, passed through loops in the webbing thereof, the securing loops 42 of the pouch may be attached to the attachment point 28 of the retention system(s) 20, for example by being looped over the horned portions thereof. Different attachment means may be employed in the case of differently shaped attachment point 28. For example, in the case of a bollard-shaped attachment point, a securing loop 42 may be wound around the bollard one or more times. Regardless of how it is secured, when it is so secured to the attachment point of the elongated member, the securing loop 42 acts to hold the pouch 40 (or other associated article) fast to the MOLLE 12 by virtue of the elongated members 22*a*, 22*b* of the retention system 20 being laced through the loops of webbing 14. This helps prevent movement of the pouch 40 with respect to the MOLLE 12 when it is being worn. When removing the pouch 40 from the MOLLE 12, or for another reason, the securing loop 42 may be disengaged from the attachment point 28 of an elongated member by pulling on its associated pull tab 44. This will cause the securing loop 42 to be elongated, allowing the user to uncouple the securing loop 42 from the attachment point 28.

As discussed above, the retention system 20 may be secured to the MOLLE 12, in part, by the use of gate 26. As illustrated, the gate 26 may be in the form of a locking wire or an elastic (or nearly so) band (e.g., an O-ring) that is secured to one of the elongated members 22*a*, 22*b*, and which can be fitted to the other elongated member in a recess or notch 36 thereof. More generally, the gate 26 is securably engaged to a first one of the elongated members 22*a*, 22*b*, and is moveable between an open position, as shown in FIG. 6, in which the gate does not obstruct the longitudinal opening 24 of the retention system 20 and a closed position, as shown in FIG. 5, in which the gate obstructs the longitudinal opening 24 of the retention system 20. To do so, when in the closed position the gate 26 may removably engage one of the elongated members, for example by removably engaging the one of elongated members at a recess 36 in a longitudinal outside edge of the one of the elongated members. When in the open position, the gate 26 may hang freely from the other of the elongated members, as shown in FIG. 6, or may removably engage the other one of the elongated members at a recess in a longitudinal outside edge of that other one of the elongated members (not shown in these views). Thus, each respective one of the elongated members 22*a*, 22*b*, may include a recess in its respective longitudinal outside edge for removably engaging the gate.

Figure 7:
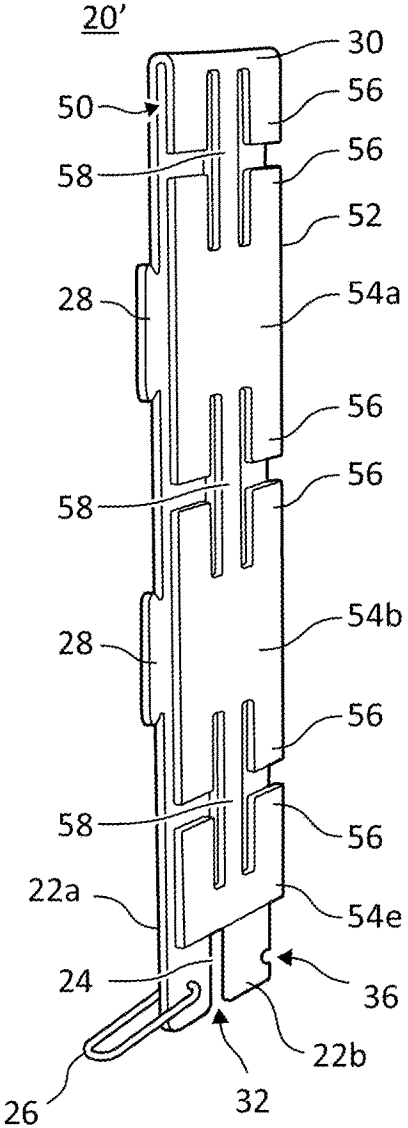
FIG. 7 illustrates an alternative embodiment of a retention system configured in accordance with embodiments of the present invention which includes a gap between a common base portion and elongated members, the gap being adapted to receive portions of a webbing to which the retention system will be fitted.

Referring now to FIG. 7, in some instances a retention system 20' may include a gap 50 between the common base portion 30 and the elongated members 22*a*, 22*b*, or the respective base portions of each elongated member and those respective elongated members, with the gap adapted to receive portions of a webbing to which the retention system will be fitted. For example, as shown in the illustration, such a 50 gap may be formed by the pair of elongated members 22*a*, 22*b* folding under at least part of the common base portion 30, e.g., to form a U-shaped arrangement.

In other respects, the retention system 20' is similar to the previously discussed retention system 20, and may be fitted to a MOLLE by positioning the elongated members 22*a*, 22*b* in adjacent loops of webbing so that a rib that separates the loops from one another is accommodated within the longitudinal opening 24 between the elongated members 22*a*, 22*b*. Then, the elongated members 22*a*, 22*b* may be passed through loops of successive rows of webbing of the MOLLE for their entire (or nearly so) lengths, and the end 32 of the longitudinal opening 24 closed by gate 26 below the lowermost rib of the rows of webbing loops. Attachment points 28 along one or more outside longitudinal edge(s) of elongated members 22*a*, 22*b* provide areas for securing an article being attached to the MOLLE using securing loops 42, as discussed above.

A difference in retention system 20' from retention system 20 is in how retention system 20' attaches to the article to be carried on the MOLLE. Retention system 20' includes an attachment bracket 52. Attachment bracket 52 extends from common base portion 30 and extends for at least part of the length of the elongated members 22*a*, 22*b*, separated therefrom by a distance that may be equal to, less than or more than the width of gap 50. Often, the attachment bracket 52 will be displaced from the elongated members 22*a*, 22*b* by a distance equivalent to gap width 50, but in some cases the attachment bracket may be configurable so as to increase or decrease this distance from elongated members 22*a*, 22*b* over the course of its length. That is, the attachment bracket may be flexible and so may be arranged to a desired distance from elongated members 22*a*, 22*b* over its length. In some cases, the attachment bracket 52 may be made of the same material as the elongated members 22*a*, 22*b*, while in other cases it may be made of a different material, for example, a thermoplastic acrylic-polyvinyl chloride material or other thermo-formable acrylic-polyvinyl chloride composite, plastic (e.g., Zylonite), metal and/or metal alloys, cellulose acetates (including but not limited to nylon), carbon fiber, epoxy resins, and combinations of the foregoing.

Figure 9:
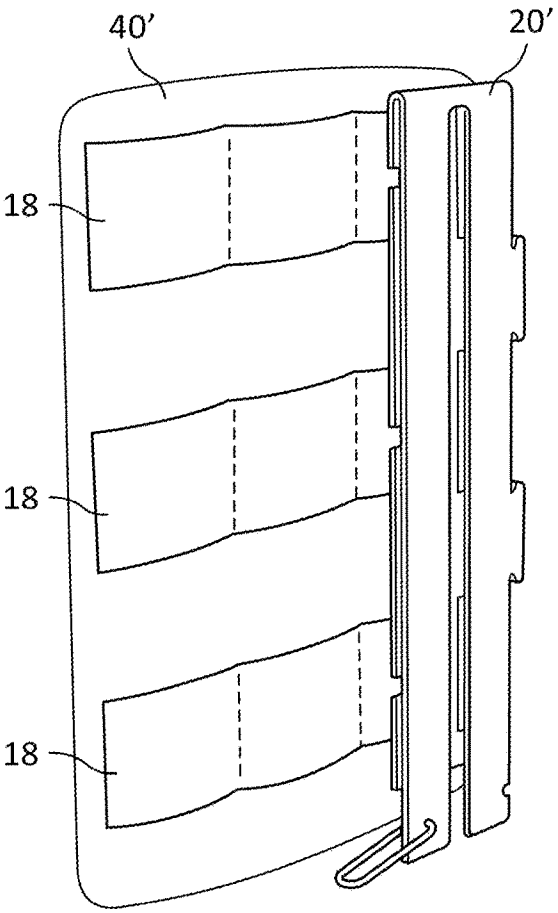
FIGS. 8 and 9 are front and back views, respectively, showing a retention system configured as in FIG. 7 with fingers of an attachment bracket allowing loops of a webbing of an article to be secured to a MOLLE.
Figure 8:
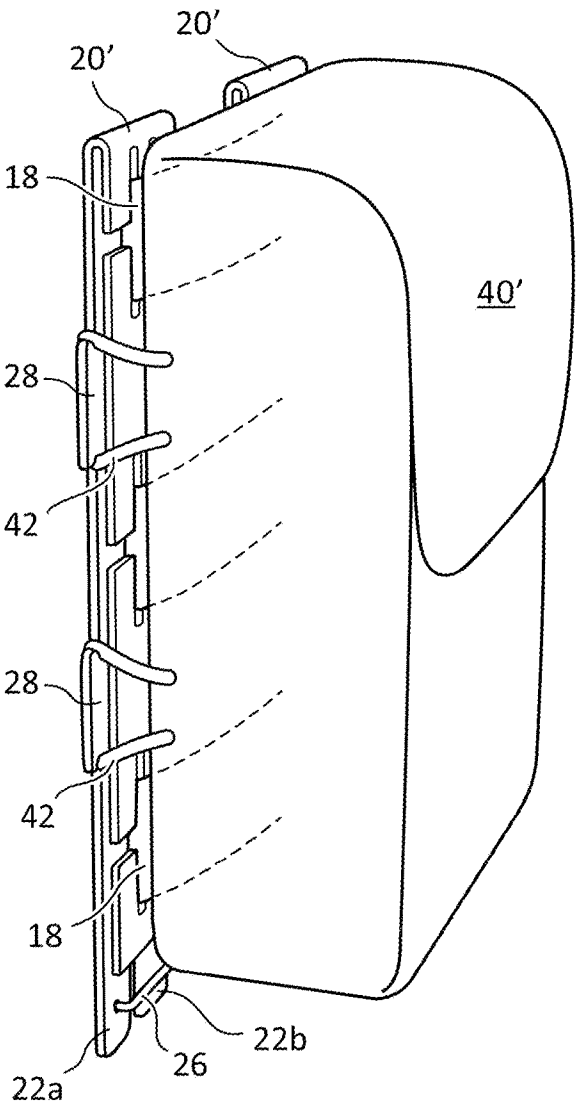

Attachment bracket 52 may have one or more segments 54*a*, 54*b*, etc., and an end piece 54*e*. Each segment 54*a*, 54*b*, etc., and end piece 54*e* of the attachment bracket 52 includes fingers 56 at one or both ends thereof. Fingers 56 may also be located at the end of common base portion 30 that is not formed to elongated members 22*a*, 22*b*. As shown in FIGS. 8 and 9, which provide front and back views, respectively, the fingers 56 of attachment bracket 52 allow loops of a webbing 18 of the article to be secured to the MOLLE, such as pouch 40', to be secured to opposite pairs of the fingers by slipping over and under (as appropriate) the opposing fingers of adjacent sections and/or the end piece. The fingers of the various segments are separated by a mid-section 58, allowing the loops of webbing 18 to be fastened to the sets of fingers on either side thereof. One or more retention systems 20' may be used per article to be secured, and various sizes of the retention systems 20' may accommodate different sized articles so that secure fastening of the article to the retention system through the use of attachment bracket 52 may be accomplished. Note, in other instances, a retention system 20' may include gap 50 between common base portion 30 and the elongated members 22*a*, 22*b*, but not the attachment bracket 52.

Figure 12:
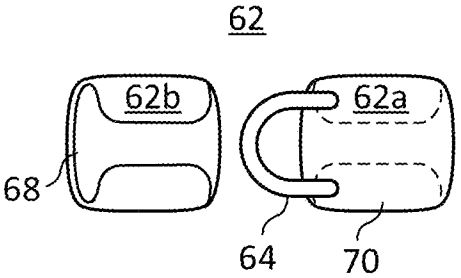
FIGS. 10-12 illustrate retention system accessories configured in accordance with embodiments of the present invention that provide securing loops for an existing or in-service article, allowing attachment to a MOLLE by a retention system configured in accordance with embodiments of the present invention.
Figure 11:
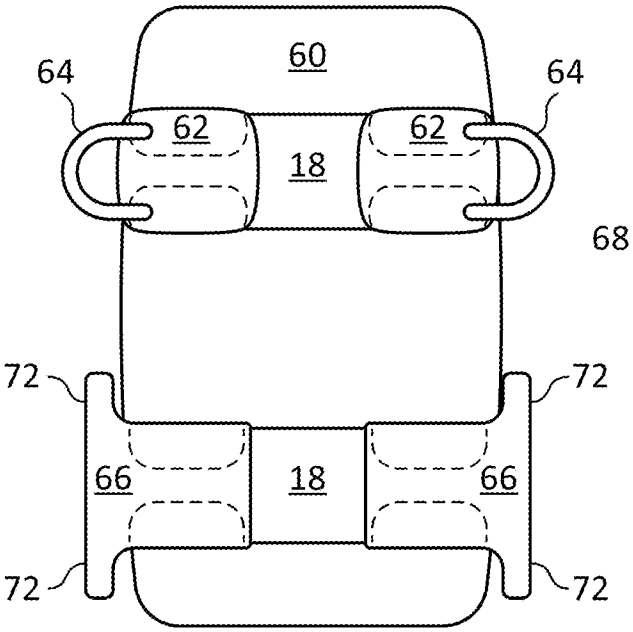
Figure 10:
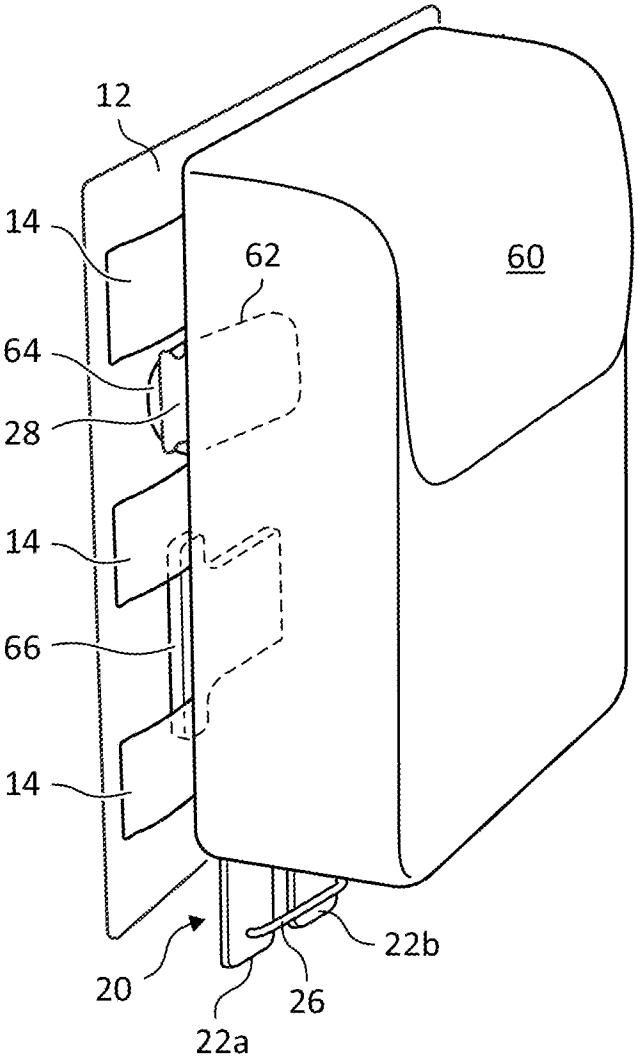

The use of securing loops 42 of an article to be attached to the MOLLE as a means for securing that article to a retention system 20, 20' works well for to-be-manufactured articles; that is, articles to be made so as to include such securing loops 42. The securing loops 42 can be sewn into such articles at the time they are manufactured. However, for articles that are already in service and which do not have such securing loops already included, a different solution is needed. FIGS. 10-12 illustrate examples of such solutions that provide means for retrofitting existing, in-service articles, such as pouches, etc., thereby allowing these in-service items to take advantage of retention systems 20, 20'.

In FIG. 10, pouch 60 is shown in front side perspective attached to MOLLE 12 by a pair or retention systems 20 (or 20') via webbing 14 on MOLLE 12. FIG. 11 shows a rear view of the pouch 60, which has a webbing 18. Secured on webbing 18 are one or more securing loop attachments 62 and/or one or more securing toggles 66. Securing loop attachments 62 and securing toggles 66 are each two-piece components that allow the pouch 60 to be secured to MOLLE 12 using retention system 20 (or 20') despite the fact that pouch 60 does not have its own securing loops. In particular, securing loop attachments 62, which are shown in greater detail in FIG. 12, are two piece units that can be secured to one another around a portion of webbing 18 of pouch 60 so as to enclose that portion of webbing between them when friction fit or otherwise secured together. A front side 62*a* of the securing loop attachment 62 has an associated securing loop 64 which, when the securing loop attachment 62 is fitted to webbing 18 of pouch 60, can be used to secure the pouch 60 to an attachment point 28 of retention system 20 (or 20') in the manner described above for securing loops 42. Although not shown in these views, the securing loop 64 of securing loop attachment 62 may have an associated pull tab similar to pull tab 44. As shown in FIG. 12, the front side 62*a* and back side 62*b* of securing loop attachment 62 may be configured to engage one another securely with a portion of webbing 18 captured between them so as to resist movement on webbing 18 when so engaged. For example, the inside of back side 62*b* of securing loop attachment 62 may have a contoured shape that is configured to mate with a recess 70 in the inside face of front side 62*a* of securing loop attachment 62. Other forms of mating arrangements may be used.

Securing toggles 66 may be of similar two-part form, with a front side piece and back side piece configured to mate with one another so as to secure a portion of webbing 18 of pouch 60 between them. Rather than a securing loop, the securing toggles 66 may include upper and lower horns 72, that, as shown in FIG. 10, are designed to fit behind straps of webbing 14 of MOLLE 12 of adjacent rows. The securing toggles 66 allow for secure attachment of pouch 60 to webbing 14 and may be removed rapidly therefrom without the need to disengage a securing loop 42, 64 from an attachment point 28 of a retention system 20, 20'. Nevertheless, it may be preferable to use at least one set of securing loop attachments 62 and one or more retention systems 20, 20' as opposed to just securing toggles 66 as the horns 72 of securing toggles 66 may come displaced from webbing 14 of MOLLE 12 under some circumstances.

Other forms of retrofitting existing, in-service articles for attachments to MOLLE using the present retention systems are also contemplated. For example, FIGS. 13A and 13B illustrate the retrofitting of articles that have existing nylon (or other) straps 16 for use with the present retention systems. The existing straps 16 are cut so as to provide only a short remaining portion 76, which is then secured to a common base portion 30 of a retention system 20 (or 20') using one or more rivets 74 or other fasteners. Although illustrated as being secured to a common base portion 30, the portions 76 of straps 16 could be secured to individual base portions of individual elongated members of the retention systems.

FIG. 14 shows yet a further embodiment of the invention in which a retention system 20 (or 20') is secured to an article, such as a pouch 80, a rear view of which is shown in the illustration. In this example, the retention system 20 (or 20') is fitted with one or more male or female strips of hook and loop fasteners 82*a*, for example by securing same to either or both of the elongated members 22*a*, 22*b* using adhesive. Complementary female or male, as appropriate, strips of the hook and loop fasteners 82 are secured to the back of pouch 80. Then when the retention system is fitted to webbing on a MOLLE, the pouch 20 can be attached to the retention system by engaging the complementary strips of the hook and loop fasteners on each. This means of attachment may be used in conjunction with the attachment points 28 and the securing loops, securing loop attachments, and/or securing toggles discussed above.

Figure 15:
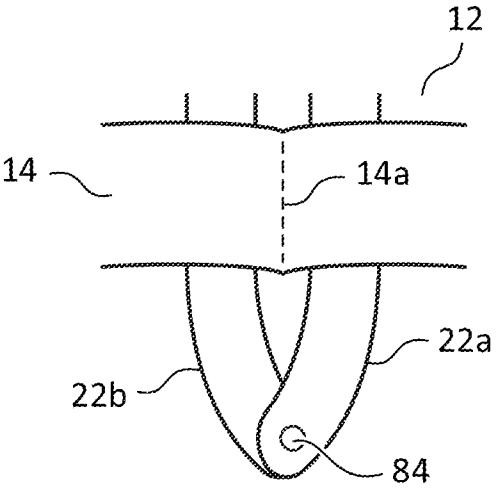

FIGS. 15-18 illustrate alternative, or additional, forms of gates 26 that may be used with any of the embodiments described herein. In FIG. 15, the gate takes the form of a snap closure 84. One of the elongated members 22*a*, 22*b* is fitted with a male portion of the snap closure near its end, and the other of the elongated members 22*a*, 22*b* is fitted with a female portion of the snap closure near its end. The two elongated members 22*a*, 22*b* are sufficiently flexible, at least near their respective ends, so as to be able to be brought together to engage the male and female portions of the snap closure 84 with one another and to separate them.

Figure 16:
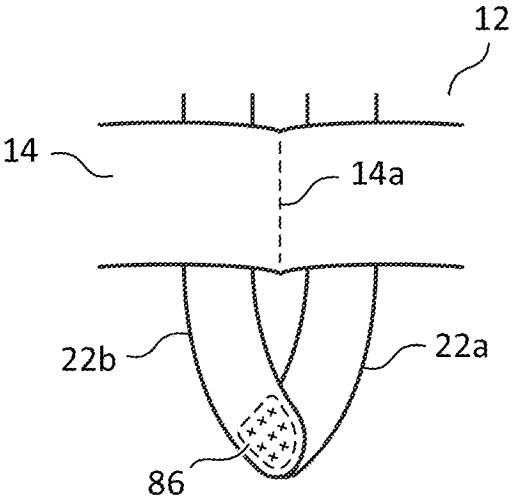
FIGS. 15-18 illustrate various forms of gates that may be used with any of the retention system embodiments described herein.

In FIG. 16, the gate takes the form of a hook and loop closure 86. One of the elongated members 22*a*, 22*b* is fitted with a male portion of the hook and loop closure near its end, and the other of the elongated members 22*a*, 22*b* is fitted with a female portion of the hook and loop closure near its end. Adhesive or adhesive tape, for example, may be used to secure the respective portions of the hook and loop closure to the elongated members. The two elongated members 22*a*, 22*b* are sufficiently flexible, at least near their respective ends, so as to be able to be brought together to engage the male and female portions of the hook and loop closure 86 with one another and to separate them.

Figure 17:
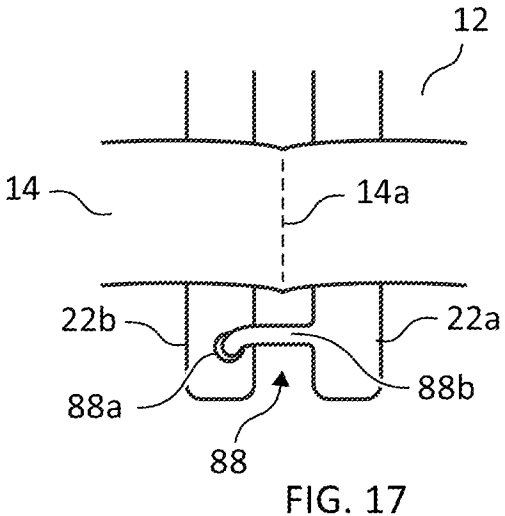

In FIG. 17, the gate takes the form of a hook and eye (or hole) closure 88. One of the elongated members 22*a*, 22*b* is fitted with the eye (or hole) 88*a* of the hook and eye closure near its end, and the other of the elongated members 22*a*, 22*b* is fitted with the hook 88*b* portion of the hook and eye closure near its end. The two elongated members 22*a*, 22*b* may be secured to one another, thereby forming the closed gate across the longitudinal opening between them, by placing the hook 88*b* portion of the hook and eye closure in the eye 88*a* portion of the hook and eye closure. To open the gate, the hook is removed from the eye.

Figure 18:
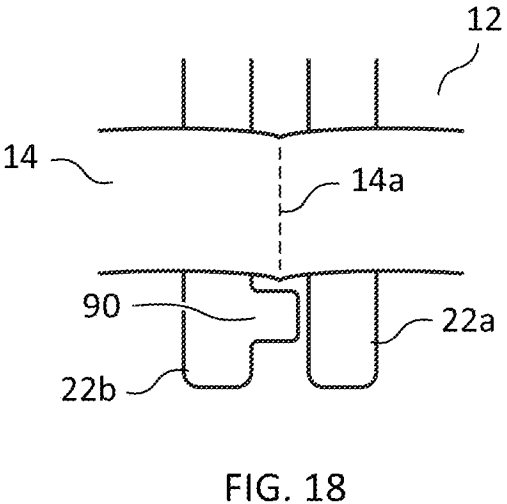

In FIG. 18, the gate takes the form of a formed extension 90 of one (or both) of the elongated members 22*a*, 22*b* near its (their) end(s). The formed extension 90 acts as a deterrent to removal of the elongated members 22*a*, 22*b* from webbing 14 because it will tend to catch the rib 14*a* in the webbing. This formed extension 90 may be of any shape and may be shaped so as to permit easier passage in one direction through a loop in webbing 14, e.g., as when the elongated members 22*a*, 22*b* are placed into the webbing loops, than in the opposite direction, e.g., as when the elongated members 22*a*, 22*b* are removed from the webbing loops. This will tend to keep the retention system 20 (or 20') in place during normal wear of the MOLLE. Note, the gate in this instance does not completely close across the longitudinal opening between the elongated members 22*a*, 22*b*, but nevertheless is a contemplated arrangement of a gate as described herein. Therefore, when the gate is referred to herein as closing across the longitudinal opening, it should be understood that the closure need not be a complete closure and that less than complete closures that are sufficient to impede the removal (typically unintentional or inadvertent removal) of the retention system from a MOLLE webbing are included in such a description.

Figure 19:
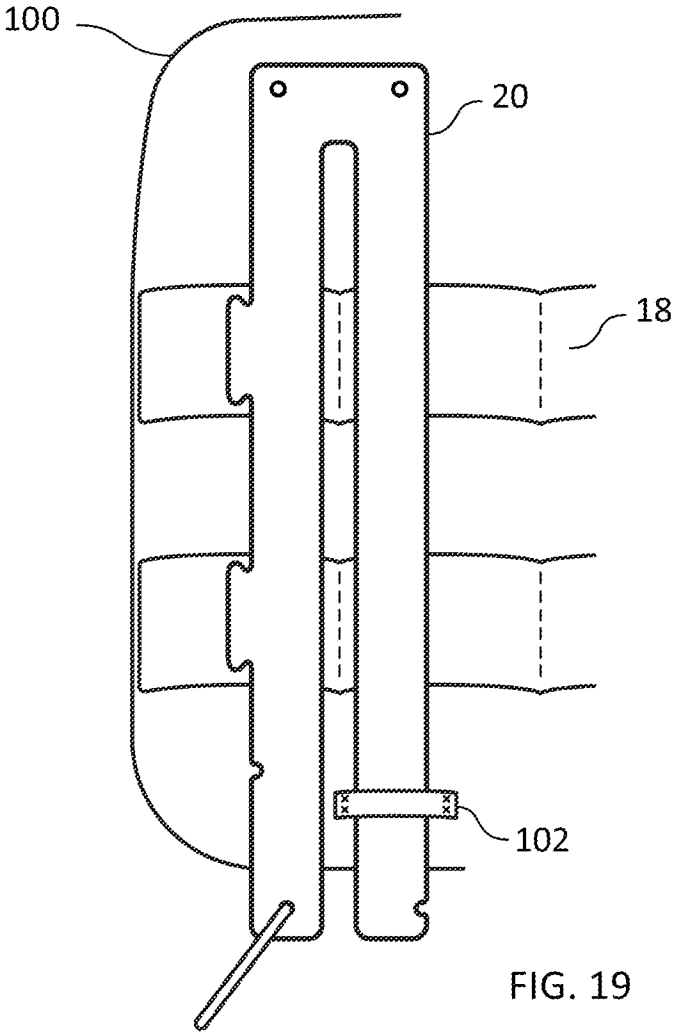
FIG. 19 shows an example of an article to be attached to a MOLLE and a retention system configured in accordance with embodiments of the present invention in which the article is fitted with a loop for receiving an elongated member of the retention system.

Referring now to FIG. 19, a further example of an article, such as a pouch 100, to be attached to a MOLLE in accordance with embodiments of the present invention is shown. In this illustration, the rear of the article with webbing 18 is depicted, and a retention system 20 (or 20') configured in accordance with embodiments of the present invention is shown attached thereto. In particular, pouch 100 has been fitted with a loop 102 towards its base. Loop 102 is attached to pouch 100, e.g., by being sewn, riveted, welded, adhered, or otherwise attached thereto, in a location so that one of the elongated members of retention system 20 passes therethrough. The presence of this loop helps to keep the retention system 20 securely attached to the pouch 100, and may avoid the need for the retention system 20 to be fitted through loops in the webbing 18.

Figure 20:
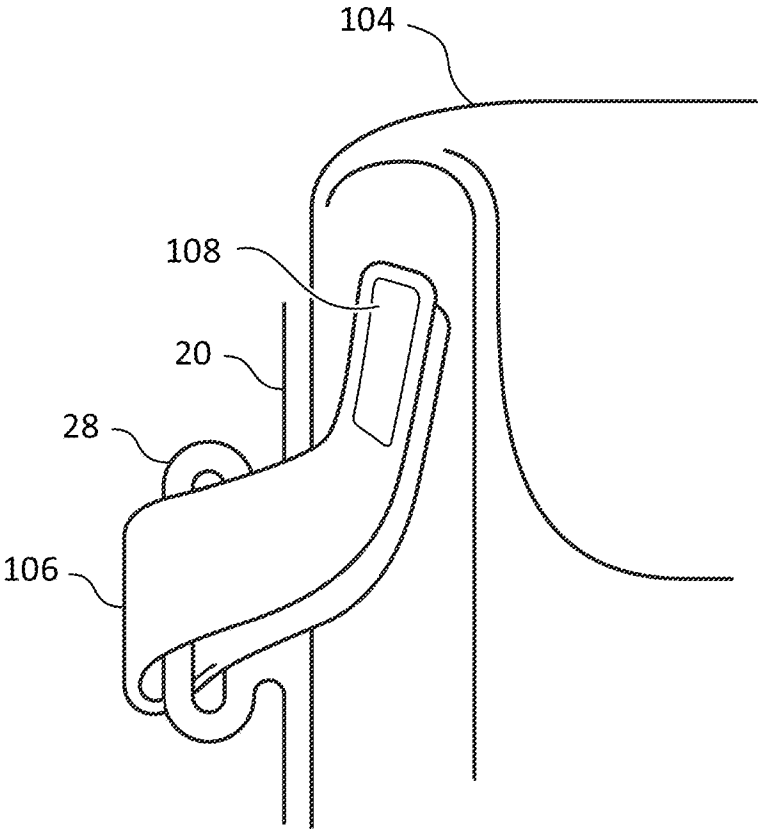
FIG. 20 shows an example of an article to be attached to a MOLLE and a retention system configured in accordance with embodiments of the present invention in which one or more attachment points of the retention system are in the form of a buckle, and the article has an associated strap that is passed through the buckle to secure it to the retention system.

In FIG. 20, a further example of attaching an article, such as pouch 104, to a retention system 20 (or 20') is shown. This time, one or more of the attachment points 28 of the retention system 20 are in the form of a buckle, and pouch 104 has an associated strap 106 that is passed through the buckle to secure pouch 104 to the retention system 20. Retention system 20 may or may not also be attached to a webbing on the pouch in any of the above-discussed arrangements. The strap 106 may be affixed at one of its ends to the pouch 104, e.g., by being sewn, welded, riveted, or otherwise secured thereto, and the other end of the strap 106 may include one part of a hook and eye closure. For example, strap 106 may have a male, or female, portion of a hook and eye closure at its free end and that male or female, portion may be secured to a complementary female, or male, as applicable, portion of a hook and eye closure that is present on pouch 104 or strap 106. Thus, when the strap is passed through the buckle of the retention system and then secured using the hook and eye closure the pouch 104 is secured to the retention system. In general, any of the closure systems discussed with reference to FIGS. 15-18 may be used for securing a strap such as strap 106 of a pouch or other article.

Figure 21:
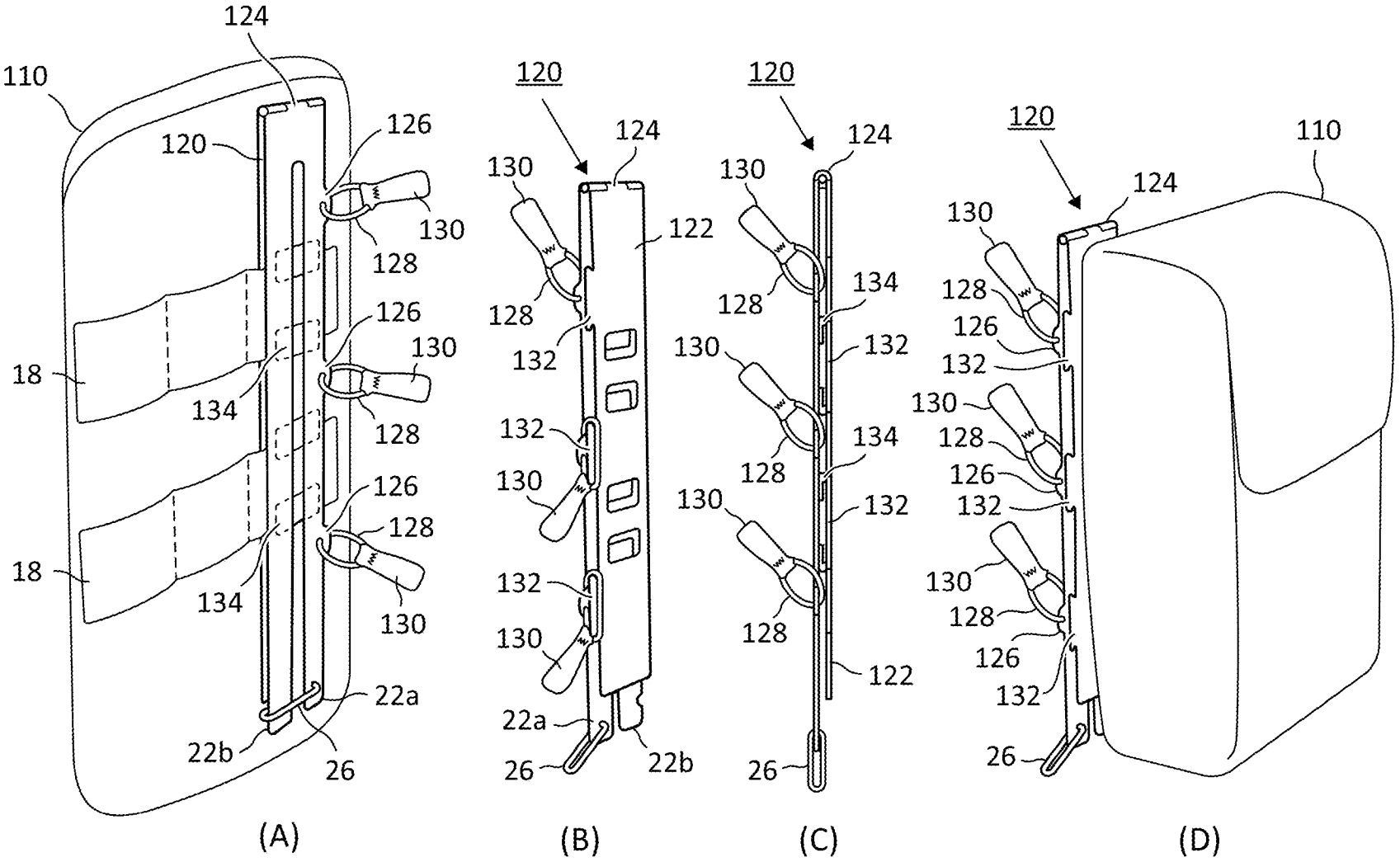
FIG. 21 includes views (A)-(D), which illustrate yet a further embodiment of a retention system configured in accordance with the present invention.

FIG. 21, which includes views (A) (a back view of a pouch with a retention system attached), (B) (a view of the retention system showing an attachment bracket), (C) (a side view of the retention system), and (D), (a perspective view of the retention system attached to the pouch) illustrates yet a further embodiment of a retention system configured in accordance with the present invention. In this example, retention system 120 is suitable for use with existing pouches 110 or other articles that include webbing 18 but may not otherwise be configured for use with a retention system as discussed above. To address this situation, the retention system 120 includes an attachment bracket 122 that may be inserted or woven through the webbing 18 on pouch 110 to secure the pouch to the retention system. C-shaped structures 134 may be used to aid in securing the webbing 18 to the retention system 120 by folding portions of webbing 18 into grooves provided by the c-shaped structures. A hinge, such as piano hinge 124, at a connection point between retention system 120 and attachment bracket 122 allows the retention system to be folded out of the way when a user is securing the attachment bracket 124 to the pouch 110 and then folded back into position for securing to a MOLLE. The hinge also allows for positioning the attachment bracket on either side of the pouch so that the attachment points 126 and loops of elastic cord 128 (discussed below) extend laterally away from the side of the pouch and are accessible to a user.

To keep the retention system 120 in a closed configuration when secured to the pouch and the MOLLE, the retention system is provided with loops of elastic cord 128 secured to elongated members 22*a*, 22*b* at one or more attachment points 126. As shown in view (B), the loops of elastic cord 128, which may be made of a heavy elasticized cord, such as shock cord, bungee cord, or similar material, can be placed around cord securing posts 132. When the retention system 120 is attached to pouch 110 via attachment bracket 122 and is also fitted to a MOLLE by having its elongated members 22*a*, 22*b*, passed through loops in the webbing thereof, the loops of elastic cord 126 may be attached to the securing posts 132 of the retention system 120, for example by being looped over the horned portions thereof. Different attachment means may be employed in the case of differently shaped securing posts 132. For example, in the case of a bollard-shaped securing post, a loop of elastic cord may be wound around the bollard one or more times. Regardless of how it is secured, when it is so secured to the securing post of an elongated member, the loop of elastic cord acts to hold the pouch (or other associated article) fast to the MOLLE by virtue of the connection it provides between the elongated members 22*a*, 22*b* and the attachment bracket 122 of the retention system 120. This helps prevent movement of the pouch with respect to the MOLLE when it is being worn. When removing the pouch from the MOLLE, or for another reason, the loops of elastic cord 128 may be disengaged from the securing posts 132 of an elongated member by pulling on its associated pull tab 130. This will cause the loop of elastic cord to be elongated, allowing the user to uncouple it from the securing post.

Note that the C-shaped structures mentioned above are optional. Also, C-shaped structures may be employed on both the attachment bracket and the elongated members. In view B of FIG. 21, an upper loop of elastic cord is in an open position, meaning it is not attached to a securing post, while two lower loops of elastic cord are in a closed position, meaning they are each attached to a respective securing post.

Figure 22:
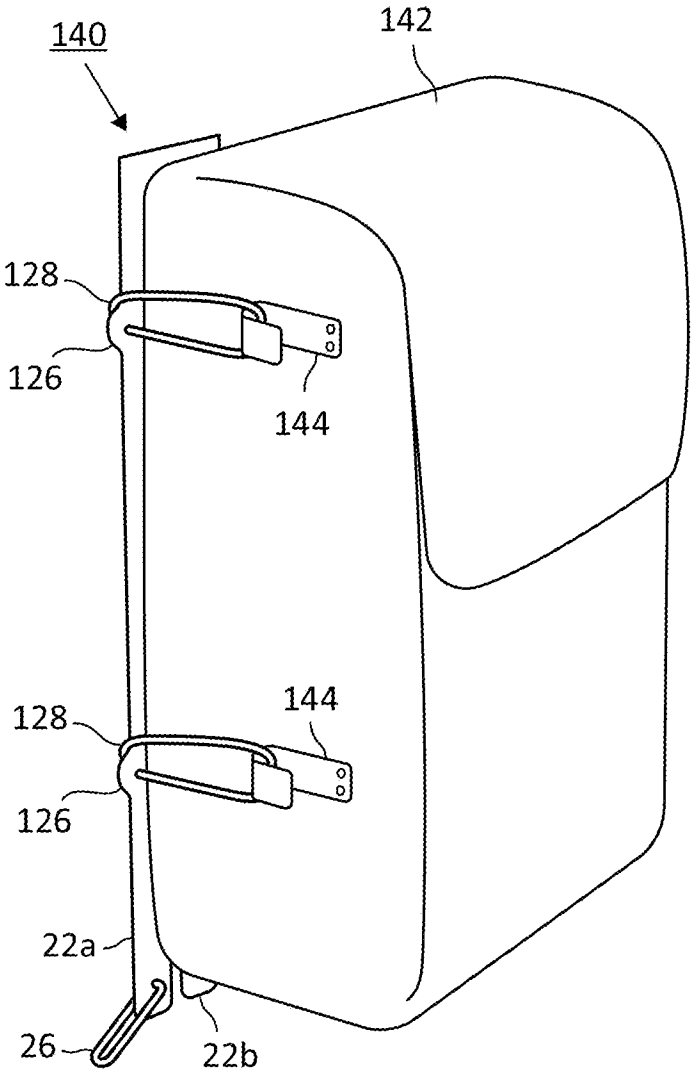
FIG. 22 illustrates yet a further example of a retention system configured in accordance with embodiments of the present invention in which an attachment bracket is used to secure an article to the retention system.

Referring now to FIG. 22, yet a further example of a retention system 140 configured in accordance with the present invention. In this example, retention system 140 is suitable for use with pouches 142 or other articles that include securing clips 144. Retention system 140 may (but need not necessarily) include an attachment bracket (not shown) that may be inserted or woven through the webbing on pouch 142 to secure the pouch to the retention system. C-shaped structures (not shown) may be used to aid in securing the webbing to the retention system by folding portions of webbing into grooves provided by the c-shaped structures, as explained above. To keep the retention system 140 secured to the pouch 142, the retention system is provided with loops of elastic cord 128 secured to elongated members 22*a*, 22*b* at one or more attachment points 126. As shown, the loops of elastic cord 128, which may be made of a heavy elasticized cord, such as shock cord, bungee cord, or similar material, can be placed around securing clips 144 of pouch 142 when the retention system 140 is attached to the pouch, for example by being looped over the hooked portions thereof. Different attachment means may be employed in the case of differently shaped securing clips 144. Regardless of how it is secured, when it is so secured to a securing clip 144, the loop of elastic cord acts to hold the pouch (or other associated article) fast to the retention system by virtue of the connection it provides to the elongated members 22*a*, 22*b*. This helps prevent movement of the pouch with respect to the MOLLE when it is being worn. When removing the pouch from the MOLLE, or for another reason, the loops of elastic cord 128 may be disengaged from the securing clips 144 of a pouch by pulling on the elastic cord (or a pull tab thereof) so as to extend and disengage it from the hooked portion of the securing clip.

Figure 1:
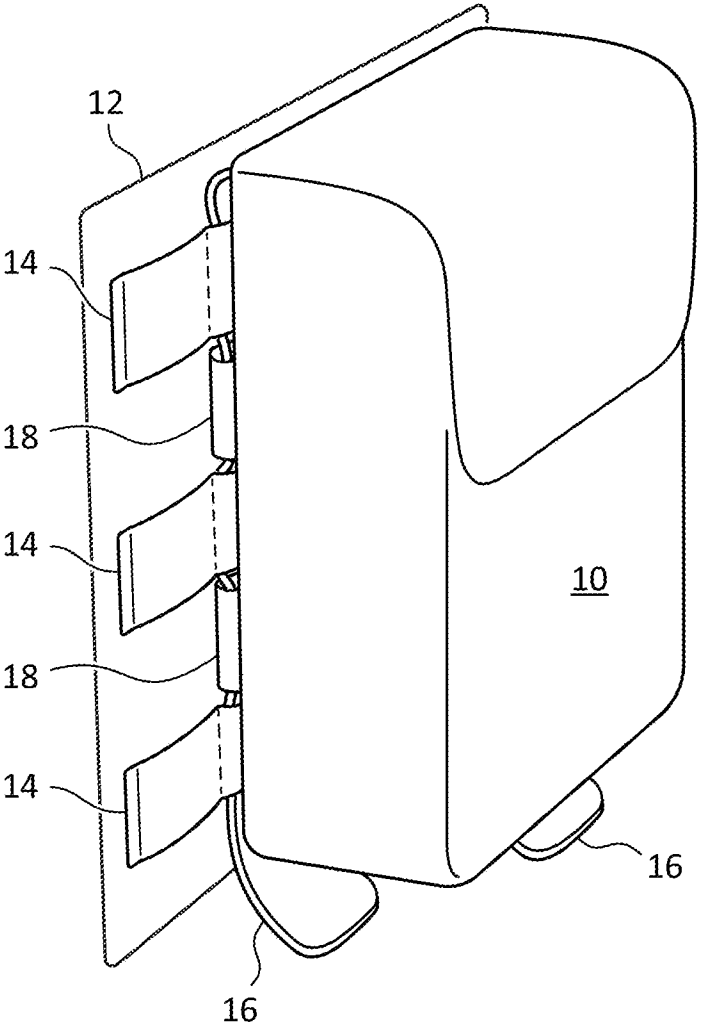
FIG. 1 (Prior Art)

Referring now to FIGS. 23A-23B and 24A-24D, yet a further embodiment of a retention system 150 is illustrated. This example of a retention system 150 may be suitable for use in connection with pouches 10 having existing straps 16, as discussed above in connection with FIGS. 1 and 2. As will be apparent from the illustrations, retention system 150 includes hingeably connected members 152*a*, 152*b*, which allow for use of the existing straps 16 without having to cut or otherwise modify them for use with the retention system.

For example, one of the hingeably connected members, 152*a* in the illustrated examples, may include a number of slots 154 through which a strap 16 may be weaved so as to secure retention system 150 to pouch 10. The other one of the hingeably connected members, 152*b* in the illustrated examples, includes elongated members 22*a*, 22*b* for securing to a MOLLE in the fashion discussed above. Notice that hingeably connected member 152*a* may include notch 36 for securing gate 26.

Figure 23B:
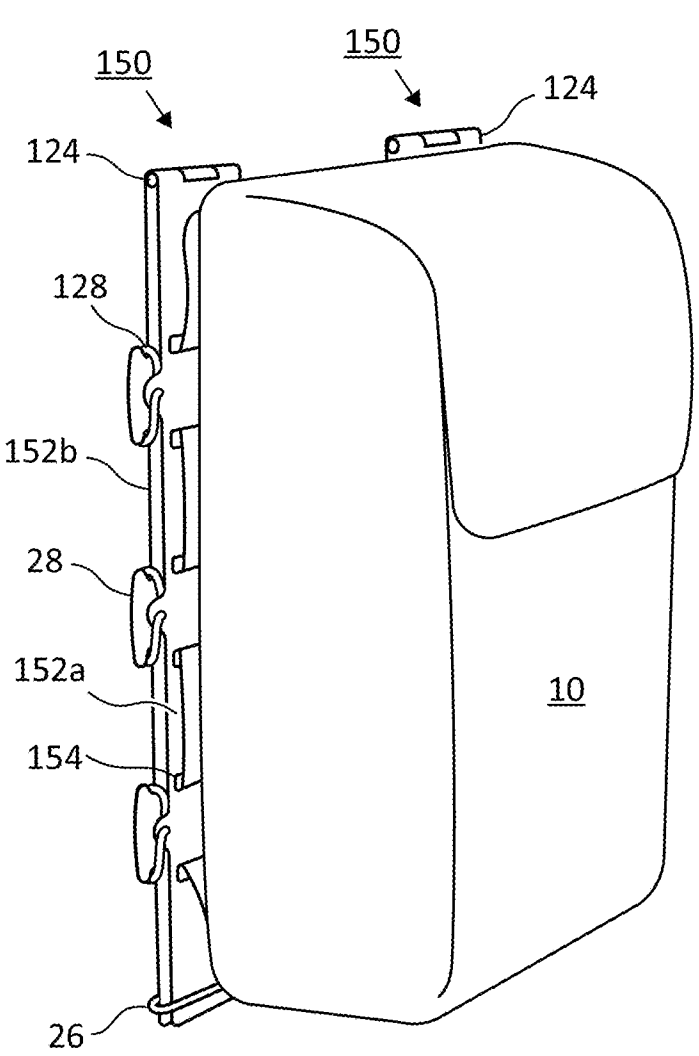
FIGS. 23A and 23B provide views of a retention system configured in accordance with embodiments of the present invention secured to an article by weaving a strap through slots in hingeably connected member of the retention system.
Figure 23A:
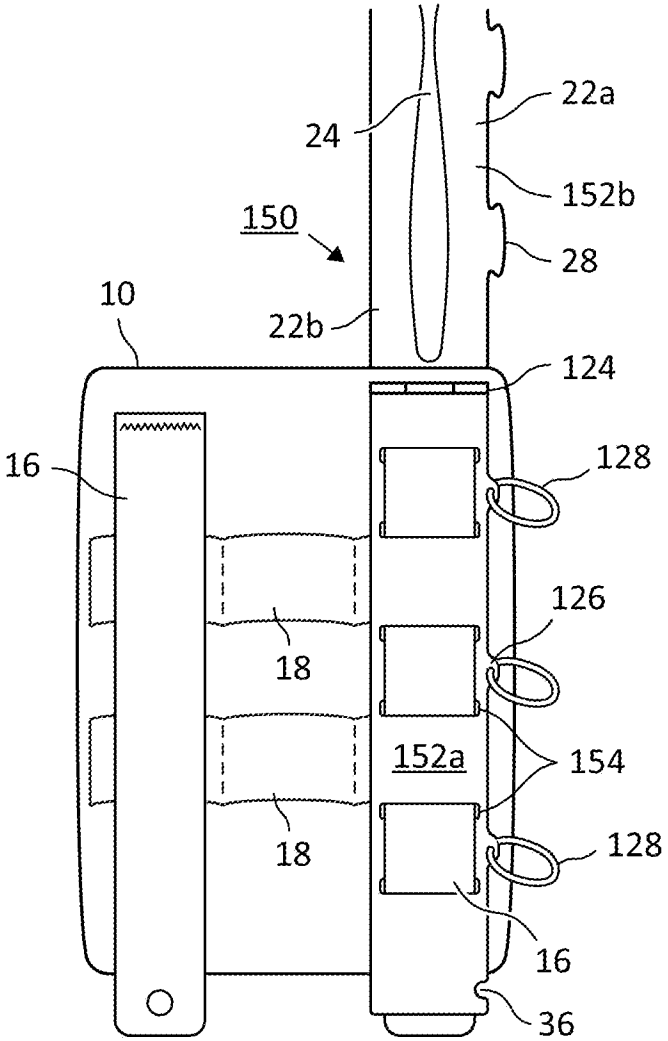
Figure 24C:
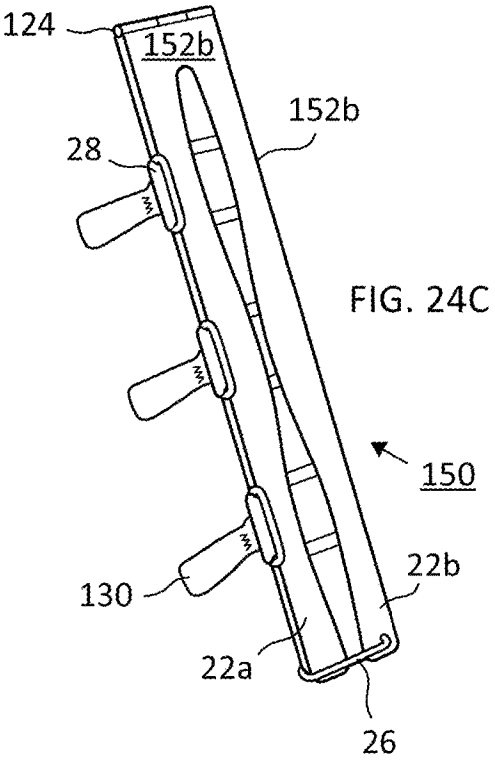
FIGS. 24A-24D illustrate a further embodiment of a retention system configured in accordance with embodiments of the present invention and suitable for use in connection with articles having existing straps, as shown in FIGS. 1 and 2.
Figure 24B:
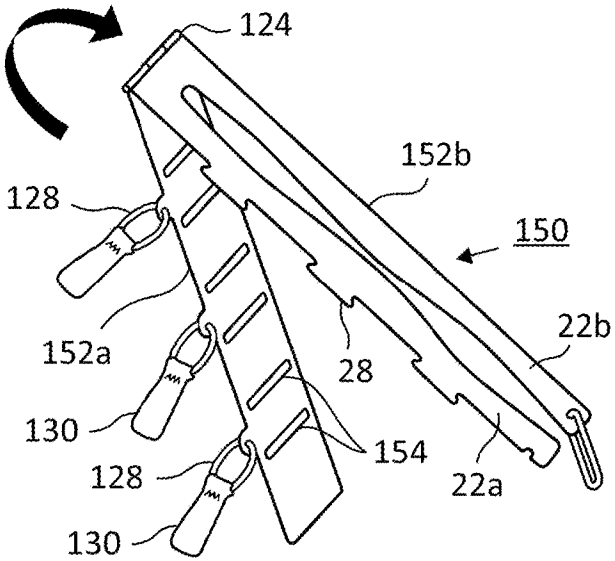
Figure 24A:
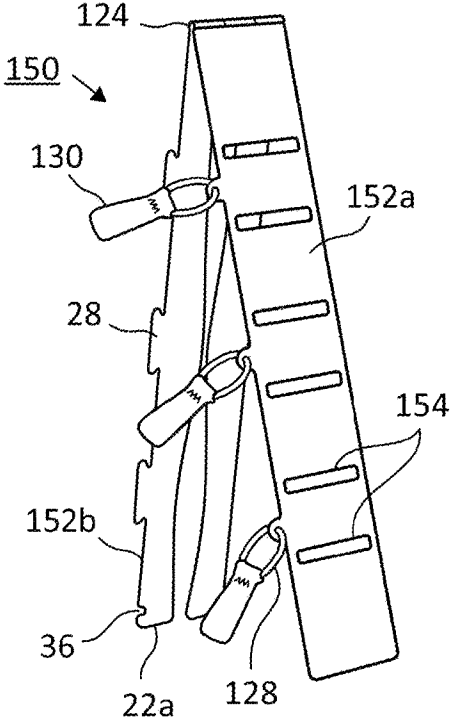
Figure 24D:
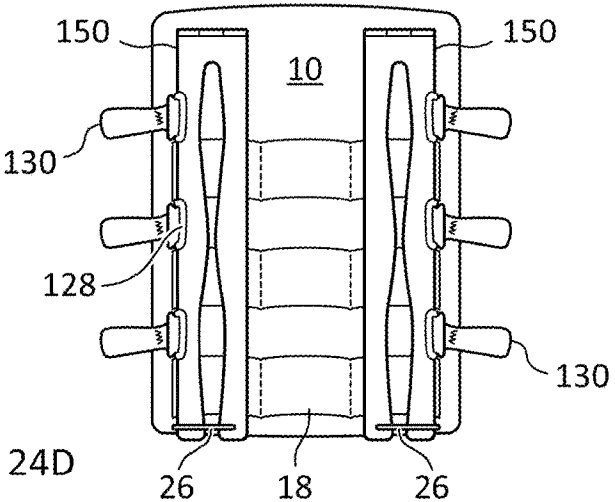

The presence of hinge 124 which couples the hingeably connected members 152*a*, 152*b* together allows the retention system 150 to be fitted to either side of pouch 10 and still have the loops of elastic cord 128, which act to hold the pouch (or other associated article) fast to the retention system by virtue of the connection it provides to the elongated members 22*a*, 22*b* at attachment points 28, accessible. For example, FIG. 23A shows a retention system 150 secured to the back of a pouch 10 by weaving a right-hand (as viewed from the back of pouch 10 as shown in the illustration) strap 16 through slots 154 in hingeably connected member 152*a*. Notice that the hingeably connected member 152*a* is oriented so that hingeably connected member 152*b*, which is shown in an open position, folds over hingeably connected member 152*b* in a way that it can be secured to a MOLLE in the fashion described above and the loops of elastic cord 128, which are secured to hingeably connected member 152*a* at attachment points 126, are laterally to the outside of pouch 10 and accessible to connect to attachment points 28 on hingeably connected member 152*b*. FIG. 23B shows the pouch 10 from its front perspective with two retention systems 150 secured thereto, one on each side of the back of pouch 10. FIG. 24D then shows the back view of pouch 10, showing the two retention systems 150 secured thereto. Notice that for the retention system 150 secured to the left-hand side of pouch 10 (as viewed from the back of pouch 10 as shown in the illustration), the hingeably connected member 152*a* has been oriented with respect to so hingeably connected member 152*b* in a reverse fashion to that for the retention system 150 secured to the right-hand side of pouch 10. That is, hingeably connected member 152*a* has been folded over hingeably connected member 152*b*, as shown in FIGS. 24A (retention system 150 oriented in a first arrangement with hingeably connected member 152*a* on a back side of hingeably connected member 152*b*), 24B (retention system 150 in the process of being oriented in a second arrangement with hingeably connected member 152*a* on a front side of hingeably connected member 152*b* by virtue of being rotated about the hinge 124), and 24C (retention system 150 oriented in the second arrangement with hingeably connected member 152*a* on the front side of hingeably connected member 152*b*) so that it can be secured to a MOLLE in the fashion described above and the loops of elastic cord 128, which are secured to hingeably connected member 152*a* at attachment points 126, are laterally to the outside of pouch 10 and accessible to connect to attachment points 28 on hingeably connected member 152*b*. The retention system 150 is thus reversible and can be attached to a conventional pouch or other article that has similar straps and webbing available without need to retrofit the pouch or otherwise alter its existing straps or webbing. This is a particular advantage of the hinged embodiments of the present retention system and makes the present retention system compatible with a wide range of existing, in-service articles that are designed for attachment to a MOLLE or similar system that includes PALS or similar webbing for the attachment of various accessories.

Figure 25:
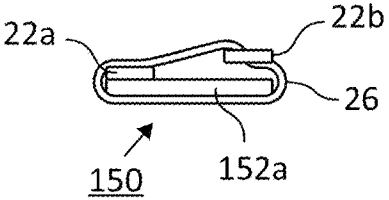
FIG. 25 shows a bottom view of a retention system configured in accordance with embodiments of the present invention illustrating how a securing gate may fit over both of a pair of hingeably connected members of the retention system, securing them together.

FIG. 25 shows a bottom view of a retention system 150 showing some detail of how the securing gate 26, which may be a loop of elastic cord, fits over both hingeably connected members 152*a*, 152*b*, securing them together. In practice, the securing gate 26 would be so fitted after the retention system 150 is secured to both the pouch or other article and to the MOLLE and the securing gate 26 would be positioned below a bottom-most webbing loop of the MOLLE so as to hold the retention system 150 in place on the MOLLE. The presence of a rib between webbing loops on the MOLLE acts to prevent the retention system 150 from becoming dislodged from the MOLLE as the securing gate 26 would prevent the retention system 150 from moving out of the webbing loops. In some embodiments, similar securing gates 26 may be used in connection with webbing loops other than or in addition to a bottom-most webbing loop when the retention system is fitted to a MOLLE. When removing the pouch from the MOLLE, or for another reason, the loops of elastic cord 128 may be disengaged from an attachment point 28 by pulling on the elastic cord (or a pull tab 130 thereof) so as to extend and disengage it from the horned portion of the attachment point.

Features and attributes of the disclosed embodiments described above are not necessarily exclusive to the embodiments with which they were introduced. In other words, the features and attributes of the various embodiments may be used in others of the disclosed embodiments, even if not specifically mentioned in connection therewith in the foregoing discussion.

As should be apparent from the above, embodiments of the disclosed invention may provide increased horizontal article placement positions on PALS or similar webbing of a MOLLE or similar wearable apparatus, while allowing for stable and secure attachment thereto. Increasing the horizontal placement positions is achieved by replacing traditional pouch straps with the present retention system, which includes more rigid and split/forked elongated members, which may be routed under sewn loops of webbing in a traditional manner, or alternatively, routed in a way that captures the sewn portion (e.g., a rib) of the webbing between the loops in a gap provided by the split/forked elongated members. This ability to capture and retain the stitching of the sewn portions of webbing allows articles to be positioned in "half-step" increments horizontally versus only "full-step" increments as can be achieved with traditional pouch straps and attachment methods that can only route such straps under open loops. Securing articles by capturing the stitch line or sewn portion between the loops of a webbing also provides for a more robust connection to the webbing as loops of webbing tend to stretch and become loose over time and securing articles to same using traditional fabric strips suffers under such conditions.

As should be evident from the examples discussed herein that refer to a pouch as an instance of an attachable item, both elongated members of the split/forked design of the improved retention system can be routed under sewn loops on a MOLLE or other an article that the pouch is being attached to. Using a vest as an example of such an article to which a pouch is being attached, a user can route one elongated member of the split/forked design under all the available sewn loops on the vest while routing the other elongated member through only a select number of sewn loops. This can be advantageous when desiring to inhibit removal of the pouch as this method captures the webbing and provides a lock by connecting the elongated members. The present design also provides for a locking effect when routing the elongated members in a manner that captures a stitch line between the elongated members. This is accomplished by closing a gate between the elongated members under the stitch line or rib between the loops of webbing.

In addition, embodiments of the invention may employ rigid or semi-rigid elongated members that provide retention to a vest or similar article by being routing under sewn loops in the webbing of the article and then attach the pouch to exposed portions of the elongated member(s) located between adjacent rows of webbing at specific attachment points. This may be accomplished using elastic cord formed into loops and attached to the pouch at the specific attachment points of the retention system. This releasably connects the pouch to the elongated members at one or more locations and provides for a tight connection between the pouch and the vest that is equivalent to or better than that provided by weaving traditional nylon straps. The connection can be improved further by using a hook and loop connection between the elongated members and the back of the pouch. When the pouch is connected to the elongated members via the elastic cord, a locking effect is provided as the elastic cord inhibits the elongated members from being moved vertically by interfering with the bottom portion of the sewn loop directly above it. To remove the pouch, the elastic cord is pulled free from the attachment point on the elongated member directly or by using a pull tab attached to the cord. Once the elastic cords are pulled free and the elongated members are unlocked, the pouch can be easily removed by lifting it up and away from the vest.

Thus, a retention system for securing articles to webbing or similar attachment system has been described.

What is claimed is:

1. A retention system for securing an article to a webbing, the retention system comprising one or more rigid or semi-rigid elongated members to fit to said webbing by being accommodated within loops of said webbing, wherein a pair of said rigid or semi-rigid elongated members are separated from one another at least along a portion of their respective lengths by a longitudinal opening and joined to one another at a first respective end of each thereof opposite an open end of the longitudinal opening, and one or more of said members including one or more attachment points, said one or more attachment points sized to pass through the loops in the webbing and shaped to receive a securing loop of said article.

2. The retention system of claim 1, further comprising a gate near the open end of the longitudinal opening.

3. The retention system of claim 2, wherein the gate is configured to at least partially obstruct the open end of the longitudinal opening.

4. The retention system of claim 2, wherein the gate is positionable between a first position in which the gate does not obstruct the open end of the longitudinal opening and a second position in which the gate obstructs the open end of the longitudinal opening.

5. The retention system of claim 2, further comprising a gap between the elongated members and a base portion of the retention system, said gap to receive portions of the webbing.

6. The retention system of claim 2, wherein the gate is one of: a locking wire, an elastic ring, a locking unit rotatable about a position on one of the elongated members, a member that swings closed and open, a cap that covers ends of the elongated members, a barrel bolt latch, a chain latch, a portion of one or both of the elongated members, a hook and loop closure system, a snap closure system, a hook and hole closure arrangement, and a portion of one or both of the elongated members that forms a narrowing of the longitudinal opening between the elongated members near their respective ends.

7. The retention system of claim 5, wherein the gap is formed by the pair of elongated members folding under the base portion.

8. The retention system of claim 5, further comprising an attachment bracket displaced from the elongated members by approximately a width of said gap.

9. The retention system of claim 1, wherein at least one of the attachment points is along an exterior longitudinal edge of its respective elongated member.

10. A retention system for securing an article to a webbing, comprising hingeably connected rigid or semi-rigid elongated members, a first one of said members including slots therein to receive securing elements of said article and a second one of said members to fit to said webbing, either of the first one of said hingeably connected members or the second one of said hingeably connected members includes one or more attachment points sized to pass through loops in the webbing and sized to receive a securing loop of said retention system.

11. The retention system of claim 10, wherein one of said hingeably connected members includes a notch for a securing gate.

12. The retention system of claim 10, wherein the one or more attachment points are positioned along an exterior longitudinal edge of their respective elongated member.

13. The retention system of claim 10, wherein the securing loop of said retention system is one or more loops of elastic cord secured to whichever of the hingeably connected members does not include the one or more attachment points.

14. The retention system of claim 13, wherein one of the first one of said hingeably connected members or the second one of said hingeably connected members includes a securing gate.

15. The retention system of claim 13, wherein the securing gate fits to whichever of the first one of said hingeably connected members or the second one of said hingeably connected members does not include the securing gate.

* * * * *